US008276319B2

(12) United States Patent
Duffy

(10) Patent No.: US 8,276,319 B2
(45) Date of Patent: Oct. 2, 2012

(54) FIRE RESISTANT ACCESS PANEL FOR DUCTS AND AIR HANDLING EQUIPMENT

(75) Inventor: William Christopher Duffy, Thornhill (CA)

(73) Assignee: Durasystems Barriers, Inc., St. James (BB)

( * ) Notice: Subject to any disclaimer, the term of this patent is extended or adjusted under 35 U.S.C. 154(b) by 1119 days.

(21) Appl. No.: 11/797,712

(22) Filed: May 7, 2007

(65) Prior Publication Data

US 2008/0115418 A1 May 22, 2008

Related U.S. Application Data

(63) Continuation of application No. 11/363,931, filed on Mar. 1, 2006, now abandoned, which is a continuation of application No. 09/874,327, filed on Jun. 6, 2001, now abandoned.

(51) Int. Cl.
*E06B 3/32* (2006.01)

(52) U.S. Cl. ..... 49/466

(58) Field of Classification Search ..... None
See application file for complete search history.

(56) References Cited

U.S. PATENT DOCUMENTS

| | | | |
|---|---|---|---|
| 624,715 | A | 5/1899 | Wenz |
| 3,123,880 | A | 3/1964 | Barry et al. |
| 4,859,320 | A | 8/1989 | Beall, Jr. |
| 4,913,127 | A | 4/1990 | Dugger |
| 5,067,278 | A | 11/1991 | Lyons |
| 5,165,189 | A | 11/1992 | Besal |
| 5,356,048 | A | 10/1994 | Geiser |
| 5,538,377 | A | 7/1996 | Stewart et al. |
| 5,901,502 | A | 5/1999 | Rafalski et al. |

FOREIGN PATENT DOCUMENTS

| | | |
|---|---|---|
| FR | 2719347 | 4/1994 |
| GB | 2045321 | 3/1979 |

*Primary Examiner* — Jerry Redman

(74) *Attorney, Agent, or Firm* — Harness, Dickey & Pierce, P.L.C.

(57) ABSTRACT

An access panel assembly for providing access to a duct through an opening in the duct. The access panel assembly comprises a sealing member, a cover member and fasteners. The sealing member fits around the opening in the duct and the cover member fits over the sealing member and coupled to the duct by the fasteners. The cover member may comprise a fire resistant panel and is formable to the shape of the duct thereby allowing the access panel assembly to be fitted to irregular shaped ducts or openings in the ducts. The access panel assembly allows easy and ready access to the interior of ducts or other air handling equipment to permit the inspection and cleansing of the interior surfaces and other interior components of any contaminants.

13 Claims, 5 Drawing Sheets

FIRE RESISTANT ACCESS PANEL FOR DUCTS AND AIR HANDLING EQUIPMENT

DOMESTIC PRIORITY

This is a continuation application of application Ser. No. 11/363,931 filed Mar. 1, 2006, now abandoned which is a continuation of application Ser. No. 09/874,327 filed Jun. 6, 2001, now abandoned the entire contents of which are hereby incorporated by reference.

FIELD OF INVENTION

The present invention relates to ducting systems and air handling equipment, and more particularly to an access panel for ducting systems and associated air handling equipment.

BACKGROUND OF INVENTION

All ducts systems require access panels of one type or another to enable the inspection of the interior of the ducts, to allow the cleaning of the duct surfaces and to maintain any equipment such as fire dampers, volume dampers, etc. that may be installed in the duct.

Some ducts, such as grease ducts, contain a grease residue, and are required to be cleaned so as not to pose a fire hazard. The NFPA 96 standard requires that access panels large enough to permit thorough cleaning be provided at 12 ft. intervals in the duct. While many systems when they are designed and installed meet the NFPA requirement, in most cases it is not until the system is to be cleaned that it is discovered that due to the duct size, system design and other modifications done to the surrounding areas after installation, additional access panels are needed to allow proper cleaning of the duct. Since grease is extremely flammable, it is not advisable to weld new access panels on ducts that have been exposed to grease, and therefore other techniques are required to retrofit access panels.

One known approach involves using an access door assembly comprising a mounting and support frame, a releasably secured cover, a seal interposed between the cover and mounting and support frame. The access door assembly is held in position and secured to the duct by support studs. Such an approach utilizing a support/mounting frame suffers from a number of disadvantages as discussed below.

First, the utilization of a mounting and support frame limits the locations on the duct where the access door can be installed, and such an arrangement is not modifiable in the field. Furthermore, the frame prevents installation on ducts with other than flat surfaces thereby eliminating use on ducts with non-flat contours. The frame also prevents the shape of the door from being modified in the field to enable installation close to obstructions such as building members or other building services.

Second, the mounting and support frame when, installed inside a duct creates a surface raised above the normal duct interior causing grease to accumulate around the frame itself.

Third, by having the support studs protrude outwardly from the duct surface, it is not possible to install the access door into a duct with non-flat contours Without creating elongated holes in the duct equal to or greater than the length of the support stud. Such elongated holes could protrude beyond the edge of the access door thereby creating leakage.

Fourth, the support studs protrude outwardly from the duct surface and as such causing a potential safety hazard to the personnel inspecting or cleaning the ducts. The protruding support studs can cause lacerations, bruising and even lead to falls from ladders as a result of clothing or equipment catching on the protruding fasteners.

Accordingly, there remains a need for an access door assembly which overcomes the perceived shortcomings of the prior art.

SUMMARY OF THE INVENTION

The present invention provides an access panel suitable use with ducting systems and air handling equipment. The access panel comprises a fire resistant access panel that allows easy entry to inspect and clean the inner duct and equipment surfaces of any accumulated dirt, greases and oils that can create a fire hazard, and to perform maintenance to any internal equipment as required.

In a first aspect, the present invention provides an access panel access panel assembly for providing access to a duct through an opening in the duct, said access panel assembly comprises, a sealing member adapted to fit around the opening in the duct; a cover member adapted to fit over said sealing member and cover the opening in the duct; a plurality of fasteners for coupling said cover member to the duct, said cover member being formed to the shape of the duct.

In another aspect, the present invention provides a frameless access panel assembly for providing access to a duct through an opening in the duct, said access panel assembly comprises: a sealing member adapted to fit around the opening in the duct; a cover panel adapted to fit over said sealing member and cover the opening in the duct; a plurality of fasteners for coupling said cover member to the duct; said cover panel being formed to the shape of the duct.

In a further aspect, the present invention provides a field modifiable access panel assembly for providing access to a duct through an opening in the duct, the access panel assembly comprises a sealing member adapted to fit around the opening in the duct; a cover member adapted to fit over the sealing member and cover the opening in the duct; a plurality of fasteners for coupling the cover member to the duct; the cover member comprising a material modifiable in the field to conform the shape of the duct.

in yet another aspect, the present invention provides method for installing in the field an access panel for providing access to a duct, the method comprises the steps of: cutting an opening in the duct, the opening having a size sufficient to provide the required access to the duct; forming mounting holes around the perimeter of the opening; attaching clip fasteners to the duct around the opening, each of the clip fasteners being in communication with one of the mounting holes; placing a sealing member around the opening, the sealing member having holes in communication with the mounting holes; placing a cover member over the sealing member to cover the opening and affixing said cover member to the duct using fasteners mounted in the mounting holes and coupling to the clip fasteners.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Reference will now be made to the accompanying drawings, which show, by way of example, a preferred embodiment of the present invention, and in which:

FIG. 3(*b*) is an exploded cross-sectional view of the access panel assembly shown in FIG. 1;

DETAILED DESCRIPTION OF THE PREFERRED EMBODIMENTS

Figure 1:
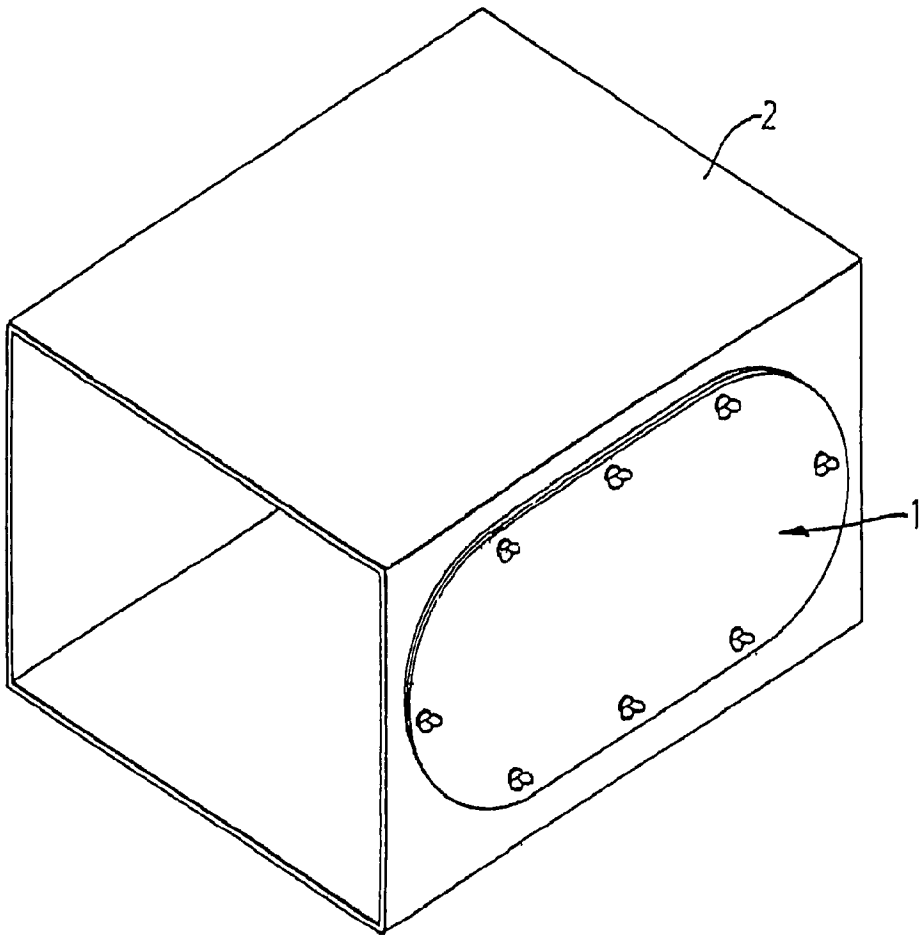
FIG. 1 is an isometric view of an access panel according to the present invention installed in a rectangular duct.

Reference is first to made FIG. 1, which shows an access panel assembly according to the present invention and indicated generally by reference 1. As shown, the access panel 1 is coupled to a duct 2 and positioned in a closed position. The duct 2 has a rectangular cross-section and the access panel 1 is mounted on one of the flat side-walls. As will be described in more detail below, the access panel assembly 1 is field modifiable and suitable for use with ducts having various cross-sectional shapes and forms.

Figure 2:
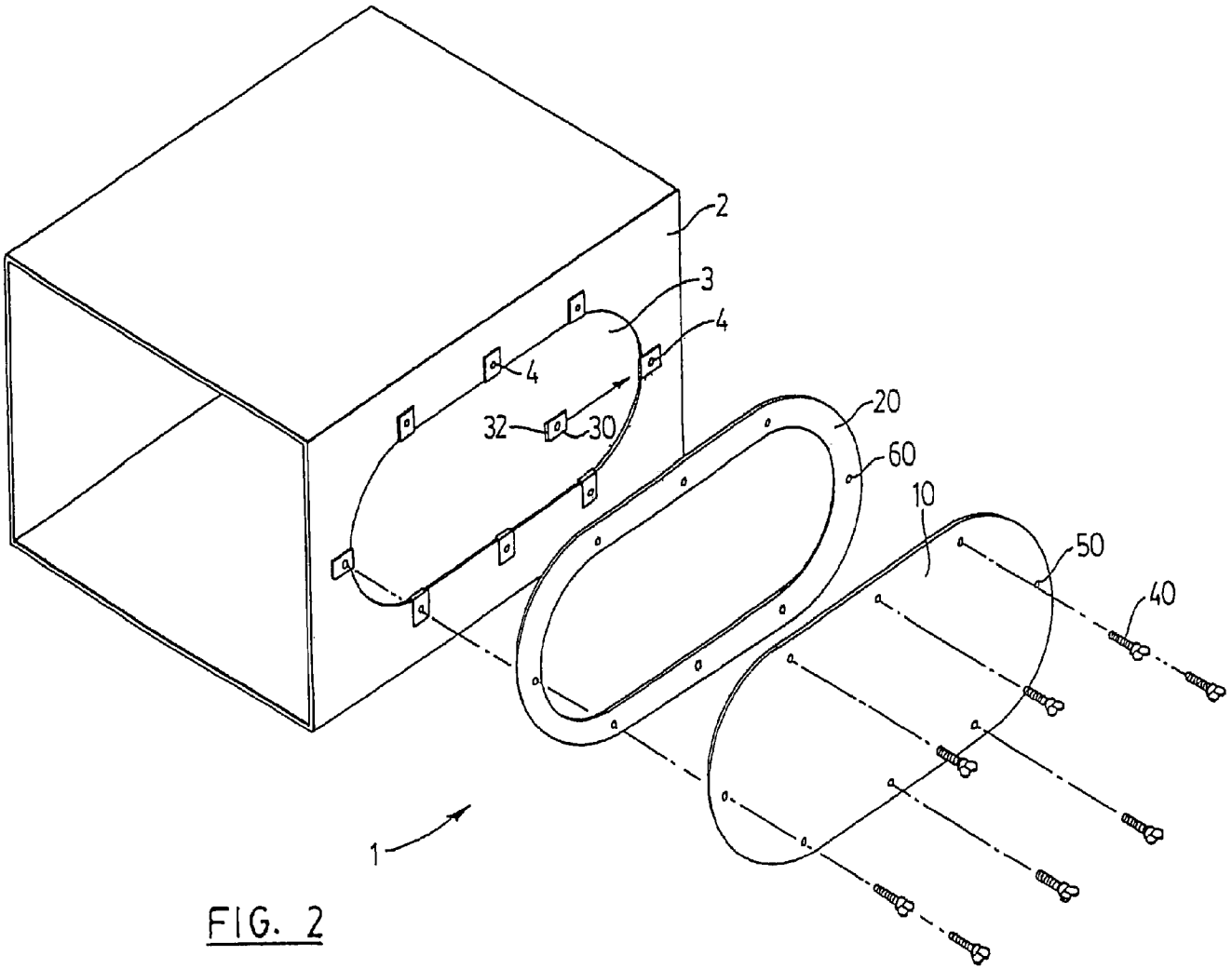
FIG. 2 is an exploded isometric view of the access panel assembly shown in FIG. 1.

Referring next to FIG. 2, the access panel assembly 1 is shown in an open position. The access panel assembly 1 comprises a cover plate or panel 10, a gasket 20, spring clips 30, and threaded stud fasteners 40.

As shown, the duct 2 has an opening 3 cut in the side-wall. A series of mounting holes 4 are drilled or punched in side-wall around the periphery of the opening 3. The spring clips 30 are attached around the edge of the duct opening 3 and in line with the mounting holes 4 that were drilled into the duct wall. The spring clips 30 have a threaded portion which receives the threaded studs 40 and provide the female threads for a screw fastening system. As shown, the cover plate 10 and the gasket 20 include mounting holes 50 and 60 which are aligned and in communication with the mounting holes 4 in the side-wall of the duct 2. The threaded studs 40 are inserted through the mounting holes 40 and 50 on the cover plate 10 and gasket 20, respectively, and screwed into the spring clips 30. The threaded studs 40 are tightened to press the cover plate 10 to the gasket 20 and compress the gasket 20 against the side-wall of the duct 2, thereby providing an airtight seal, i.e. fire and grease tight seal, as shown in FIG. 1 and the sectional view in FIG. 3(*a*). To provide access to the duct 2 via the opening 3, the threaded studs 40 are loosened and unscrewed and the cover plate 100 and gasket 30) removed as shown in sectional view of FIG. 3(*b*).

Figure 3B:
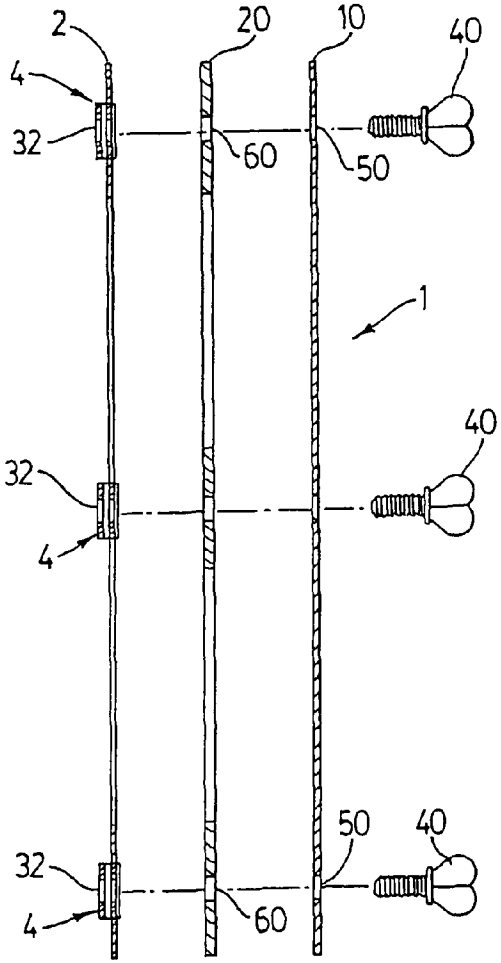
FIG. 3(*a*) is a cross-sectional view of the access panel assembly shown in FIG. 1.
Figure 3A:
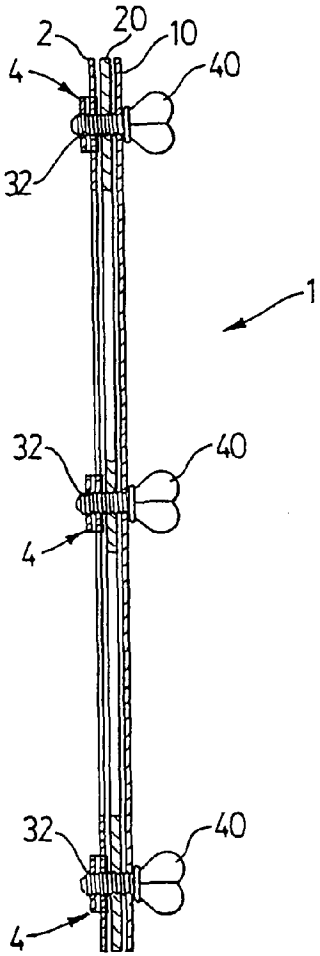

Preferably, the spring clips 30 are of a replaceable clip type which advantageously allows for easy replacement of the female threads of the fastening system in the event that a threaded stud fastener 40 is over-tightened and strips or damages the threaded portion of the spring clip 30. It will appreciated that stripping of the threads in the spring clips 30 will not be a common occurrence, the ability to replace damaged fasteners provides the capability to ensure the continued fire resistance of the access panel 1. The threaded stud fasteners 40 preferably include a winged head (as shown in FIGS. 3(*a*) and 3(*b*)) to facilitate opening and closing the access panel 1, while at the same time providing a low profile to avoid causing contact injury or catching a technician's clothing. The threaded stud fasteners 40 are of sufficient diameter and material to prevent failure when exposed to a grease type fire. Threaded stud fasteners 40, other than winged head types, are suitable, and types that do not require tools for removal, for example threaded studs with integral shaped heads or socket cap screws with pressed on formed handles.

Figure 4:
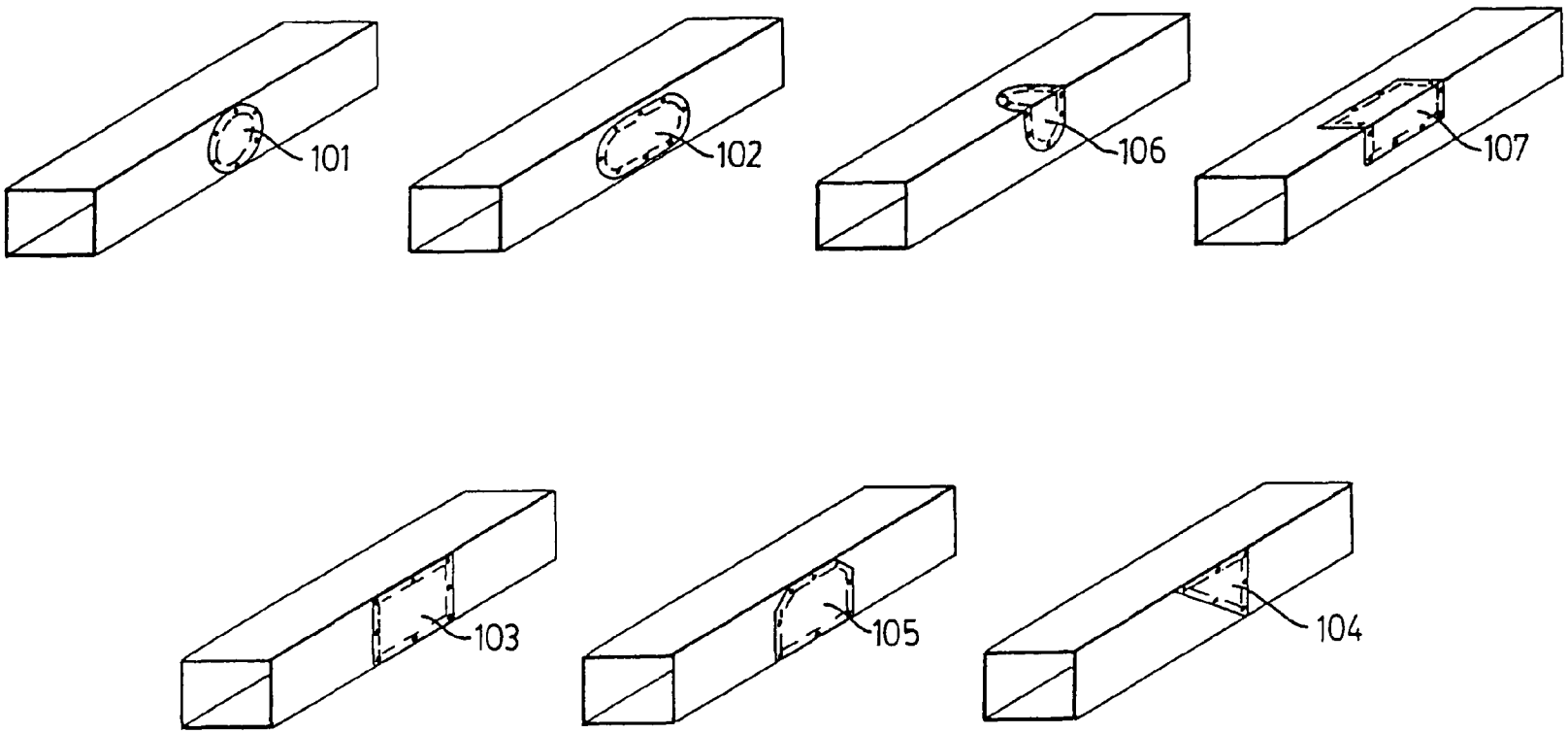
FIG. 4 is an isometric view of a number of field modifiable configurations of the access panel according to the present invention for different installations involving square and rectangular and other flat sided ducts.
Figure 5:
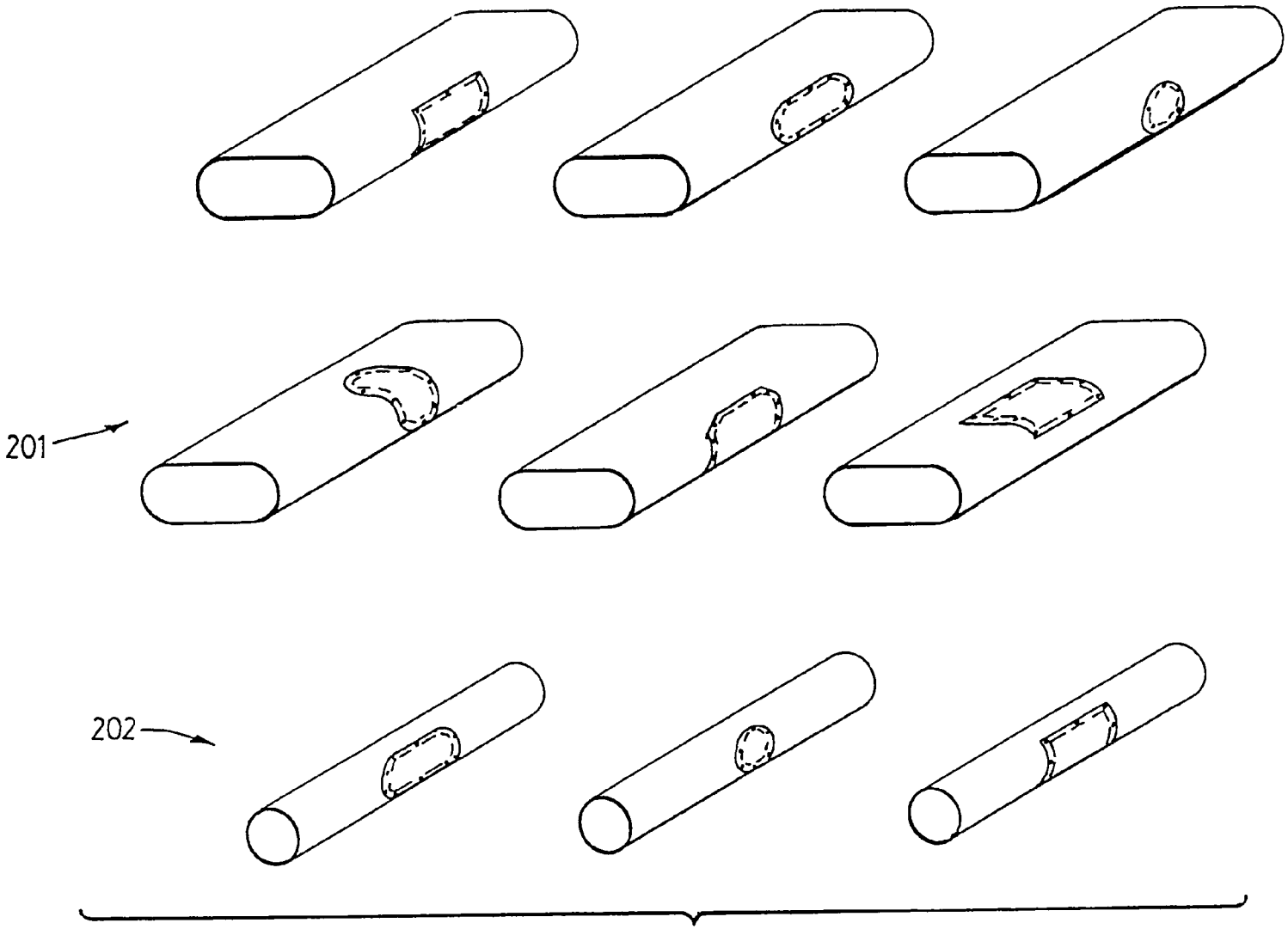
FIG. 5 is an isometric view of a number of field modifiable configurations of the access panel according to the present invention for different installations involving round, oval and other ducts with curved sides.

For many applications, a 16ga metal sheet is suitable for fabricating the cover plate 10. However, the thickness of the cover plate 10 will vary based on the particular application. As shown in FIGS. 4 and 5, the cover plate 10 maybe formed and cut into a variety of shapes. Based on the configuration of the access panel assembly 1, the cover plate 10 is advantageously field modifiable and can be shaped (e.g. bent) to conform to the shape of the duct 2 and/or cut to fit the duct 2 and access space surrounding the duct, for example, the corners of the cover plate 10 may be cut as for the configuration 105 shown in FIG. 4. To provide an optimal seal, the cover plate 10 is preferably sized to overlap the opening 3 in the duct 2 by an equal amount around the periphery of the opening 3 (FIG. 1). Similarly, the mounting holes 50 (FIG. 1) in the cover plate 10 are located around the periphery of the cover plate 10 at a distance from the edge of the cover plate 10 of one half of the overlap.

For fire resistant access applications, the gasket 20 comprises a high temperature material which when compressed provides a seal impervious to fire and any contaminants that may be located within the duct 2. Preferably, the gasket 20 has the same shape as the cover plate 10 and is sized so that its width is equal to or larger than the overlap between the opening 3 in the duct 2 and the cover plate 10. The gasket 20 is attached to the cover plate 10 so that the mounting holes 60 in the gasket 20 are located as to align with the mounting holes 50 in the cover plate 10 through which the thread fastener studs 40 pass. For other types of applications, e.g. non-fire resistant conditions, the gasket 20 does not have to be a high temperature type.

According to another aspect, the access panel assembly 1 is suitable for ducts 1 have various cross-sectional shapes and forms or access requirements. As shown in FIG. 4, the access panel 1 may have a circular shape 101, an oval shape 102, a rectangular shape 103, and a triangular shape 104. The access panel 1 can also be cut or shaped to accommodate fittings or obtrusions proximate the duct 1, for example, as shape 105. In addition, the access panel 1 can be formed to span more than one side-wall or surface of the duct 2, for example as shape 106 or shape 107. As shown in FIG. 5, the access panel 1 may be suitably formed to ducts having different cross-sectional shapes, for example, a duct 201 having an oval cross-sectional shape, and a duct 202 having a circular cross-sectional shape. Each access panel 1 is formed to the cross-sectional shape of the duct 201 or 202, and also to shape of the cover panel, e.g. 101 to 107 as shown in FIG. 4. Advantageously, the access panel assembly 1 provides a high degree of flexibility and adaptability for different duct work arrangements.

To install the access panel assembly 1, it is advantageous to have a template that can be affixed to the duct 2 to enable easy location of the duct opening 3 and the locations of the mounting holes 4. With the template attached to the surface of the duct 2, the mounting holes 4 can be drilled through the template and the wall of the duct 2 at the same time. The opening 3 in the duct 2 is made using mechanical shears, reciprocating saws or any other means of cutting the duct 2 without the use of high temperatures. After the duct opening 3 is created, it is preferable to remove any burrs around the peripheral edges to eliminate the possibility of injuries during access or installation.

The spring clips 30 are positioned around the periphery of the duct opening 3 where the mounting holes 4 were drilled. The spring clips 30 have a nut side 32 which has the threaded portion. The spring clips 30 are slid over the edge of the duct opening 3 so that the nut side 32 is located in the interior of the duct 2. Preferably, the nut side 32 for the spring clips 30 has a low profile so that the spring clip 30 does not substantially protrude into the interior of the duct 2.

Next, the cover plate 10 is positioned over the opening 3 in the duct 2 so that the mounting holes 4 are aligned with the spring clips 30. A threaded stud fastener (e.g. winged head) 40 is inserted into each one of the mounting holes 50 in the cover plate 10 and passed through the gasket 20 and threaded into the corresponding spring clip 30 attached to the edge of the duct opening 3. The winged head thread stud fasteners 40 are tightened to a torque sufficient to compress the gasket 20 between the duct 2 and the cover plate 10 to create a fire and grease tight seal. If the cover plate 10 needs to shaped to conform to the shape of duct 2 (as shown in FIGS. 4 and 5), then this can be done in the shop of in the field. Similarly, if the cover plate 10 needs a custom shape to fit the duct 2 or surrounding access space, then the cover plate 10 can be cut in the field for example as shown for configuration 105 in FIG. 4.).

The present invention may be embodied in other specific forms without departing from the spirit or essential characteristics thereof. Certain adaptations and modifications of the invention will be obvious to those skilled in the art. Therefore, the presently discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. A frameless access panel assembly, comprising:

a seal configured to surround an opening in a duct; and a cover member configured to cover the opening such that the seal is disposed between a portion of the cover member and the duct, and the cover member configured to cover the opening without being mounted to a frame attached to the duct.

2. The frameless access panel assembly of claim 1, wherein the cover member is configured to have a same shape as the opening.

3. The frameless access panel assembly of claim 1, wherein the cover member is field modifiable to have a same shape as the opening.

4. The frameless access panel assembly of claim 1, wherein the cover member forms a surface that matches a surface of the duct including the opening.

5. The frameless access panel assembly of claim 1, wherein the cover member is configured to have a cross-section that matches a cross-section of a portion of the duct including the opening.

6. The frameless access panel assembly of claim 1, where the cover member is configured to have a curved surface if a surface of the duct including the opening is curved.

7. The frameless access panel assembly of claim 1, wherein the cover member is configured to have an L shaped cross-section if a cross-section of a portion of the duct including the opening is L shaped.

8. The frameless access panel assembly of claim 1, wherein the cover member and seal are fire resistant.

9. The frameless access panel assembly of claim 1, further comprising:

at least one fastener configured to fasten the cover member to the duct.

10. The frameless access panel assembly of claim 9, wherein the fastener includes a spring clip and a threaded stud member, the spring clip configured for mounting at an edge of the opening and including a threaded portion for engaging the threaded stud member.

11. The frameless access panel assembly of claim 10, wherein the cover member and the seal include mounting holes through which a portion of the threaded stud member is configured to pass.

12. The frameless access panel assembly of claim 10, wherein the threaded stud member has a tool-less head for screwing and unscrewing the threaded stud member.

13. An access panel assembly, comprising:

a seal configured to surround an opening in a duct and directly contact portions of the duct; and a cover member configured to cover the opening such that for portions of the cover member only the seal is disposed between the cover member and the duct.

* * * * *